United States Patent [19]

Reschly

[11] 4,437,452

[45] Mar. 20, 1984

[54] ROTARY CONTINUOUS ASH DISCHARGE STOKER

[75] Inventor: David C. Reschly, Monroe, Mich.

[73] Assignee: Detroit Stoker Company, Monroe, Mich.

[21] Appl. No.: 482,015

[22] Filed: Apr. 11, 1983

Related U.S. Application Data

[63] Continuation of Ser. No. 62,327, Jul. 31, 1979, abandoned.

[51] Int. Cl.[3] ..... F23H 9/00

[52] U.S. Cl. ..... 126/182; 126/242; 110/247; 110/275; 432/243; 48/66

[58] Field of Search ..... 126/242, 182, 163, 181, 126/173, 161, 162; 110/165, 275, 270, 247, 115; 48/66, 180 S, 113; 432/243

[56] References Cited

U.S. PATENT DOCUMENTS

| | | | |
|---|---|---|---|
| 548,254 | 10/1895 | Horsfall . | |
| 583,975 | 6/1897 | Bretz | 110/312 |
| 592,616 | 10/1897 | Sanderson | 126/182 |
| 700,791 | 5/1902 | Longard | 126/182 |
| 728,362 | 5/1903 | Butman . | |
| 1,513,600 | 10/1924 | Kent | 110/312 |
| 1,582,951 | 5/1926 | Wedge | 110/275 |
| 1,724,352 | 8/1929 | Ilving | 110/247 |
| 1,888,439 | 11/1932 | Stolte | 110/275 |
| 1,913,668 | 6/1933 | Haug | 48/66 |
| 1,989,662 | 2/1935 | Bernhard et al. . | |
| 2,069,584 | 2/1937 | Lorton . | |
| 2,371,191 | 3/1945 | Sherman . | |
| 2,514,657 | 7/1950 | Martin et al. | 110/247 |
| 2,533,330 | 12/1950 | Schweickart et al. | 110/275 |
| 2,548,086 | 4/1951 | West et al. | 126/182 X |
| 2,702,013 | 2/1955 | Atteberry | 110/247 |
| 2,808,321 | 10/1957 | Junkers | 126/182 |
| 3,367,644 | 2/1968 | Ban | 432/243 X |
| 3,393,904 | 7/1968 | Taylor | 432/243 |
| 3,611,542 | 10/1971 | Moore | 110/247 X |
| 3,680,503 | 8/1972 | Danielsson et al. . | |

FOREIGN PATENT DOCUMENTS

| | | | |
|---|---|---|---|
| 122232 | 8/1918 | United Kingdom | 110/312 |

OTHER PUBLICATIONS

Brochure of Morse Boulger Distruction Company, 1951.

Brochure of Nichols Engineering and Research Corp.

*Primary Examiner*—Larry Jones

*Attorney, Agent, or Firm*—Harness, Dickey & Pierce

[57] ABSTRACT

A rotary continuous ash discharge stoker having a circular grate which is designed to support burning fuel as it distributes the fuel from the feedpoint over the entire grate, and at the same time provides for the controlled admission of air for combustion of the fuel and also automatically removes from the furnace the remaining ash. The upper grate surface consists of two zones, a central stationary section and an outer rotating section or ring. The central section is inclined and is the main air admitting zone. The outer rotating ring serves to distribute the fuel in the furnace with the aid of a stationary spreader arm, admits the air necessary to complete combustion of the fuel and removes the burned out ash from the furnace with the aid of a stationary ash plow. This rotating ring is supported and guided on rails and rollers which allow for the complete rotation of this section of the grate, and has an improved wear-resistant furnace wall seal at the interface between the outer periphery of the ring and the inner periphery of the furnace wall.

34 Claims, 8 Drawing Figures

ROTARY CONTINUOUS ASH DISCHARGE STOKER

BACKGROUND AND SUMMARY OF THE INVENTION

This application is a continuation of application Ser. No. 62,327, filed July 31, 1979, now abandoned.

The present invention relates generally to mechanical stokers, and particularly to an improved construction of a rotary grate continuous ash discharge stoker. This improved construction may be used in either an overfeed or underfeed mechanical stoker design. Numerous other possible designs and combinations thereof are includible in the scope of the invention.

More particularly, the present invention relates to a rotary continuous ash discharge stoker having a circular grate which is designed to support burning fuel as it distributes the fuel from the feedpoint over the entire grate, and at the same time provides for the controlled admission of air for combustion of the fuel and also automatically removes from the furnace the remaining ash. The upper grate surface consists of two zones, a central stationary section and an outer rotating section or ring. The central section is inclined and is the main air admitting zone. The outer rotating ring serves to distribute the fuel in the furnace with the aid of a stationary spreader arm, admits the air necessary to complete combustion of the fuel and removes the burned out ash from the furnace with the aid of a stationary ash plow. This rotating ring is supported and guided on rails and rollers which allow for the complete rotation of this section of the grate. Any of several drive mechanisms can be employed to drive the rotating ring.

The present invention provides many advantages in combustion of wood, bagasse, bark, municipal refuse, coal, or any other cellulose or by-product waste fuel.

A grate surface having a substantial number of controls for fuel and air to provide for complete combustion of the fuel at a wide variety of load demands is one object of the present invention. The grate provides for movement of the fuel as it burns, moving from the feedpoint to the ash discharge point. The present invention includes various air compartments providing for control of air flow to the fuel at various points along the path of movement of the fuel. Control of air flow controls the rate of combustion of the fuel. Also, with a spreader in combination with this grate design the ash will not build up to create blow holes or dead islands, but will be burned evenly.

The circular grate surface design, furthermore, along with the combustion air control system, is not limited significantly by size and will provide an efficient mechanical stoker of any reasonable diameter having the advantages of the present invention.

A further object of the present invention is to provide all of the above objects and advantages and yet have an effective and improved wear-resistant seal between the moving grate and the furnace wall or the refractory.

Another object of the present invention is to provide continuous ash discharge from a single point. This allows for a simple ash removal and disposal system with all the ash deposited through a single chute.

If the grate is not completely covered and protected from furnace and combustion temperatures, warping or other damage to the grate can result from overheating. The present invention has the object of having a grate design in which fuel can be fed to the center feed point in such a manner that the grate is always covered by unburned fuel or ash and protected from furnace and combustion temperatures.

Substantial fuel or ash in the air chamber would significantly decrease the quality and efficiency of the combustion process. A further object of the present invention is to prevent fuel and ash from sifting into the air chamber.

When the usage situation permits, the present invention has a further advantage of reducing or eliminating clinkers or slag adhesion on the refractory by having a row of air-cooled tuyeres at the outer circumference of the grate, along the furnace wall, to provide further air for combustion. The tuyeres on the outer wall also are useful, as another air supply control, in obtaining sufficient overfire air turbulence to maintain combustion at low loads while also completing combustion at high loads, and also to reduce stratification of air and combustion products at the radially outer extreme of the grate. In some instances, however, such as when the grate is part of a gasifier unit or the like, air-cooled tuyeres on the furnace wall would not be used since such a construction would interfere with the efficient performance of the gasifier unit by diluting the desired gaseous product of combustion.

Other objects and advantages of the instant invention will be apparent in the following specification, claims and drawings.

BRIEF DESCRIPTION OF THE DRAWINGS

FIG. 3 is a side view taken along line 3—3 in FIG. 2.

FIG. 8 is a side elevational view of a furnace wall tuyere grate forming a part of the stoker of the present invention.

DESCRIPTION OF THE PREFERRED EMBODIMENT

Figure 1:
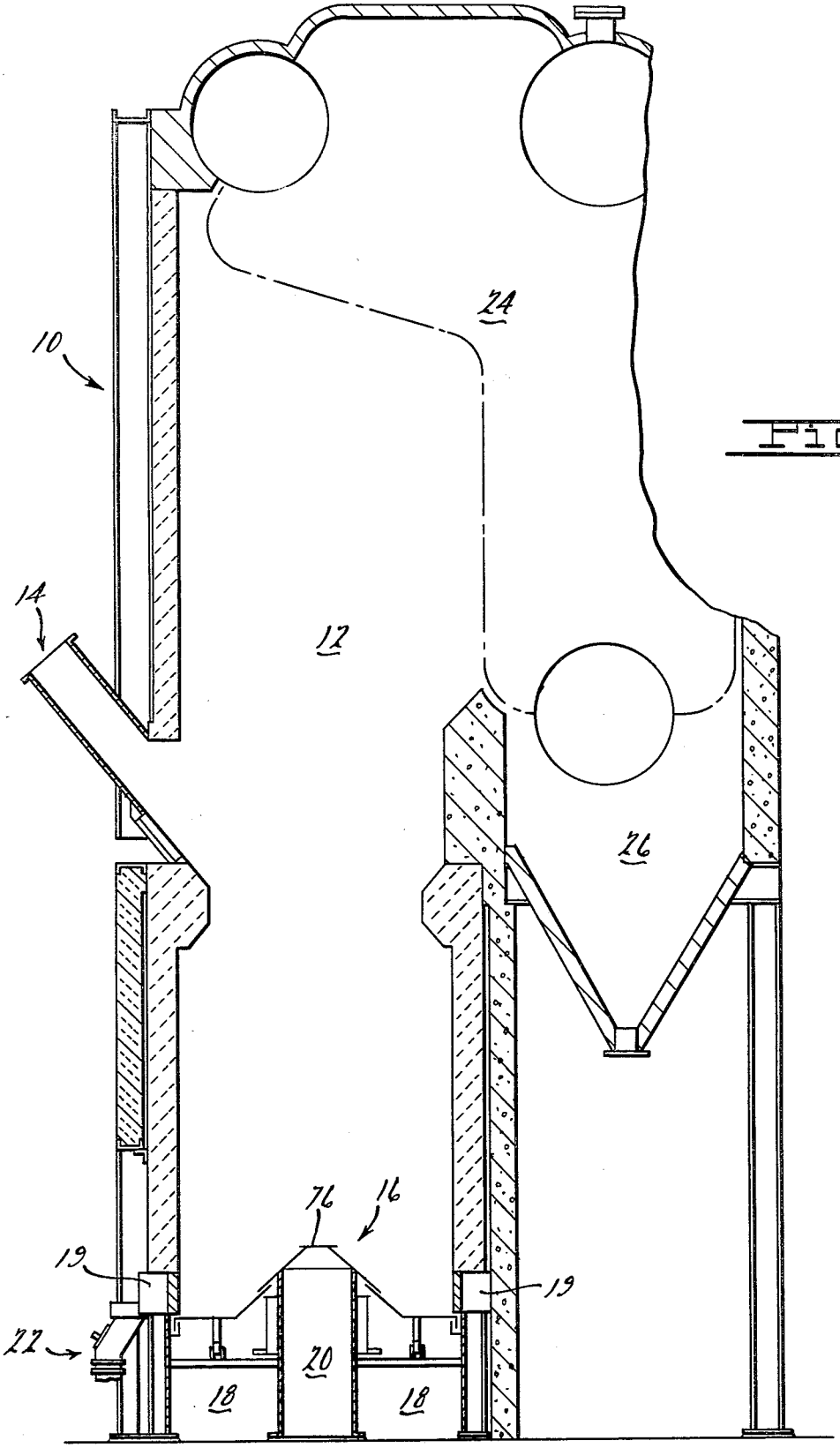
FIG. 1 is a vertical sectional view of a boiler incorporating a stoker of the present invention with certain portions broken away, the stoker being shown somewhat diagrammatically.

Referring now to FIG. 1, an improved overfeed continuous ash discharge stoker 10 is illustrated. The stoker 10 includes generally a furnace area 12, a fuel feed 14, a circular grate 16, air plenums or windboxes 18, 19 and 20, an ash collection box 22, a superheater area 24, and a collection area 26 to collect ash particles carried outside of the furnace area by the heated gases. The collected particles from the collection area 26 may or may not be directly reinjected into the furnace for further burning of any combustible that they may contain. Various other areas and devices would be included downstream of the furnace area 12 beyond the broken away portion of FIG. 1 as known in the art and not included within the scope of the invention. Not shown in FIG. 1 is the air supply unit which will be discussed infra.

Various types of conventional fuel feeders may be employed at the feedpoint 14. The fuel feeder utilized may depend on the fuel used in the stoker 10. Typical fuels utilized are bituminous and lignite coal, wood, coke breeze, bagasse, bark, municipal refuse, spent coffee grounds, or any other cellulose or by-product waste fuel. The feed 14 directs the fuel to the center cap 76 of the grate 16. The feed 14 in the preferred embodiment is directly above the ash collection box 22 to provide the optimum fuel distribution pattern and maximum residence time on the grate 16 for complete combustion of any fuel that does not reach the center cap 76 target position.

Figures 2, 5:
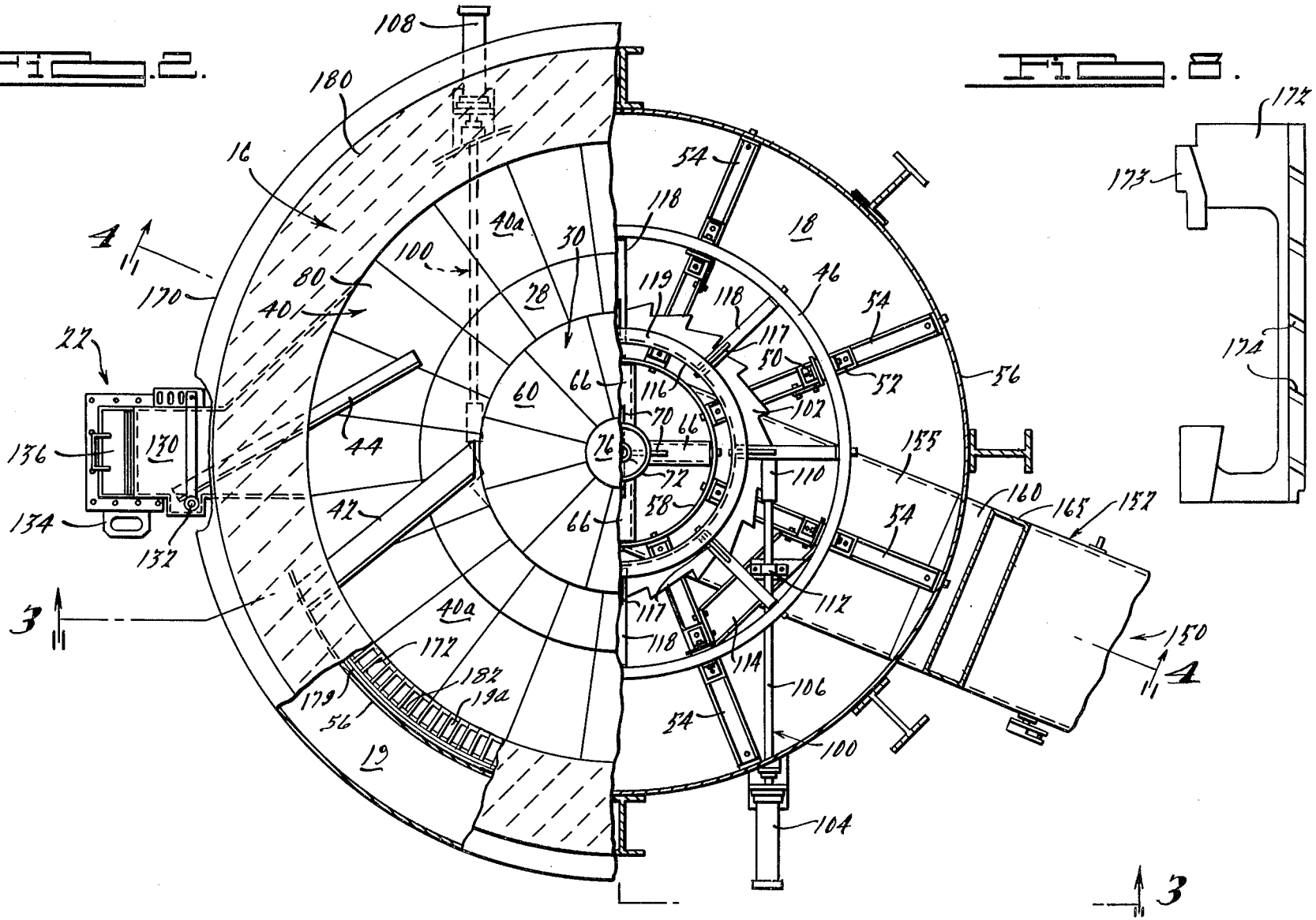
FIG. 2 is a plan view of the grate portion of the stoker of FIG. 1, with half of the view cut away showing the air supply system and drive mechanism below the grate.
FIG. 5 is an enlarged view of a portion of the apparatus shown in FIG. 3.
Figure 2:
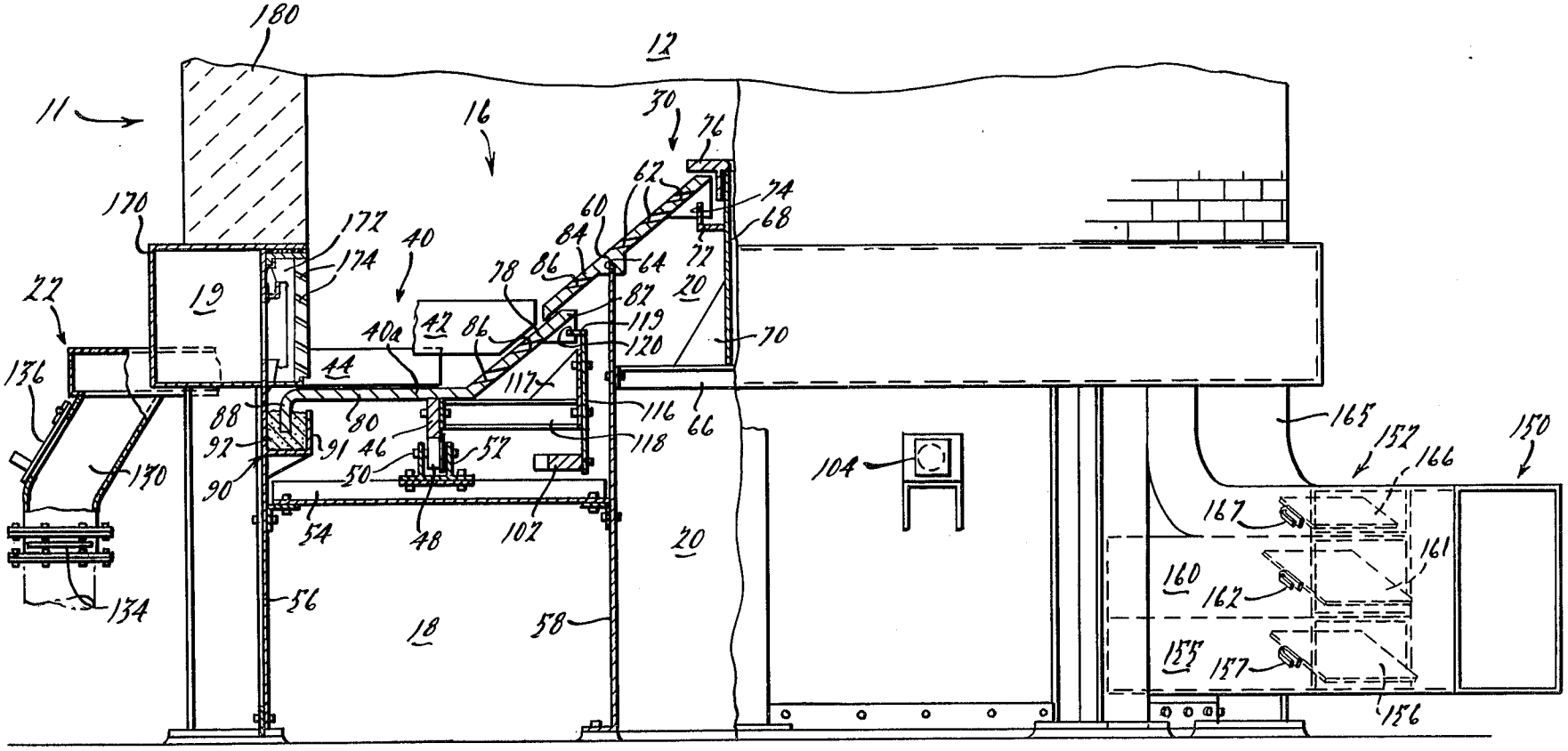

Referring to FIGS. 2 and 3, the grate 16 is shown in detail. The upper grate surface of the grate 16 consists of two zones, a central stationary section 30 and an outer rotating section or ring 40. The central section 30 is inclined and is the main air admitting zone. The outer rotating ring 40 serves to distribute the fuel in the furnace 12 with the aid of a stationary spreader arm 42 and admits air necessary to complete combustion of the fuel. The outer ring 40 also removes the burned out ash from the furnace 12 with the aid of an adjustable stationary ash plow 44.

The outer rotating ring 40 is made up of several grate sections 40*a* which are fixedly attached to an annular rail 46 and guided by rollers, generally designated 48. The rollers 48 are supported by shafts 50 in C-brackets 52. The C-brackets 52 are attached to joists 54 supported at circumferentially spaced intervals by the outer plenum wall 56 of air plenum 18 and the inner plenum wall 58 separating air plenum 18 and air plenum 20.

The stationary central section 30 of said grate 16 is of a generally conical or frusto-conical configuration and comprises an inclined circular grate 60 having a number of layers of circumferentially spaced tuyeres, generally designated 62, inset throughout the grate 60. Said tuyeres 62 are inclined downwardly, as shown in FIG. 3, to prevent fuel and ash from sifting into the air plenum 20.

The inner air plenum 20 is a cylinder and has joists 66 attached across the upper portion thereto as shown in FIGS. 2 and 3. A second stationary central support cylinder 68 is attached to said joists 66 by buttressed support brackets 70. Attached to the upper portion of cylinder 68 and integral thereto is an annular support flange 72.

The inner plenum wall 58 and the annular support flange 72 jointly support the stationary central section 30 of said grate 16 at support grooves 64 and 74 respectively, as shown in FIG. 3. A cap 76 is fixedly seated upon the top of cylinder 68 to separate the air plenum 20 from the furnace area 12.

The outer ring 40 has a radially inwardly inclined section 78 and an outer horizontal portion 80, as demonstrated in FIG. 3. The inclined section 78 has a radially inner edge 82 which is situated below the radially outer overhand 84 of the central stationary section 42. Both the outer ring 40 and the overhang 84 are located above the air plenum 18 radially outwardly of air plenum 20. The overhang 84 and the inclined section 78 each have rows of circumferentially spaced tuyeres, generally designated 86, communicating with air plenum 18 as air passages to the fuel on the grate 16 in the furnace area 12. The tuyeres 86 are downwardly directed to prevent fuel and ash from sifting into the air plenum 18.

Referring to FIG. 5, the horizontal portion 80 of the ring 40 extends radially outwardly to a downwardly extending flange 88. The flange 88 is operably associated with a furnace wall seal 90. This seal 90 comprises an annular trough 91 extending along and secured to the inner periphery of the outer plenum wall 56, filled originally with sand, ash residue or the like 92 from the combustion process to provide an effective and wear-resistant seal. During operation of the stoker 10, the ash residue of the stoker 10 refills the trough 91. The seal 90 reduces air leakage to provide a higher combustion efficiency per amount of air and fuel used.

The drive means 100 of the outer ring 40 comprises a drive ratchet 102 driven by two hydraulic cylinders 104 and 108. As shown in FIG. 2, hydraulic cylinder 104 has a drive piston 106 having a head 110 which engages the drive ratchet 102. The drive piston 106 is guided by a guide bracket 112 secured to a cross rail 114. The cross rail 114 is attached between two roller support joists 54 in a conventional manner. Hydraulic cylinder 108 is operably secured and associated with the drive ratchet 102 at the opposite drive point of the ratchet 102 such that the hydraulic cylinders 104 and 108 operate in unison to rotate the ratchet 102, although sequential operation is also within the scope of the invention.

The ratchet 102 and the outer ring 40 are interconnected by cylinder 116 and support joists 118. The drive ratchet 102 is secured to the cylinder 116 at the lower portion of said cylinder 116. The support joists 118 are attached to the cylinder 116 at circumferentially spaced intervals at an intermediate axial position of the cylinder 116 by buttressed support brackets 117. The radially outer portion of said joists 118 are connected to the annular support rail 46 of the outer ring 40. The axially upper portion of said cylinder 116 has a flange 119 which is inserted into groove 120 of each ring grate section 40*a* to laterally support the inclined section 78 of the ring 40.

Fuel is fed from above in the illustrated embodiment from the feedpoint 14 and is directed toward the cap 76 of the central stationary section 42 of the grate 16. The fuel subsequently follows a generally spiral path down the inclined grate 60 of the central stationary section 30 to the rotating inclined section 78 of the outer ring 40 onward to the outer horizontal portion 80 and is spread evenly by the spreader arm 42. Eventually the fuel is combusted into ash by the time it reaches the adjustable ash plow 44. The ash plow 44 directs the ash to the ash collection box 22. The ash plow 44 has a handle extending outwardly from the ash collection box 22 at the axis of rotation 132 of the ash plow 44 to adjust the rake of the plow.

The ash collection box is operably associated with a chute 130 and an ash treatment system (not shown), such as a clinker grinder in combination with a Dense-A-Matic unit as manufactured by the Detroit Stoker Company. The chute 130 includes a manual knife grate 134 in order to control the flow of ash into the ash treatment system and an access door 136 for manual access to the furnace 12 for manual removal of ash or other operation deemed necessary during the operation of the stoker 10.

The ash removal system formed by the ash plow 44, collection box 22, and chute 130 (to an ash treatment system) allows for continuous discharge of ash, providing for higher combustion efficiency because of the reduction in carbon loss and lower excess air requirements. The single point disposal further acts to make the overall system more cost-effective since the system allows for single station ash removal and disposal in a very complete manner. Stoker ash itself is a readily saleable item in great demand for use as aggregate in cinder block manufacture and for fill.

The air supply system 150 provides the forced draft air utilized in the combustion process which is passed through the fuel from the underside of the grate 16. The illustrated air supply duct 152 is divided into three ducts 155, 160 and 165 as it approaches the stoker housing 11. Control dampers 156, 161 and 166 are operably associated with each duct 155, 160, 165, respectively, at the inlet port of each duct as shown in FIG. 3. The dampers are controlled by adjustment knobs 157, 162 and 167.

Figure 4:
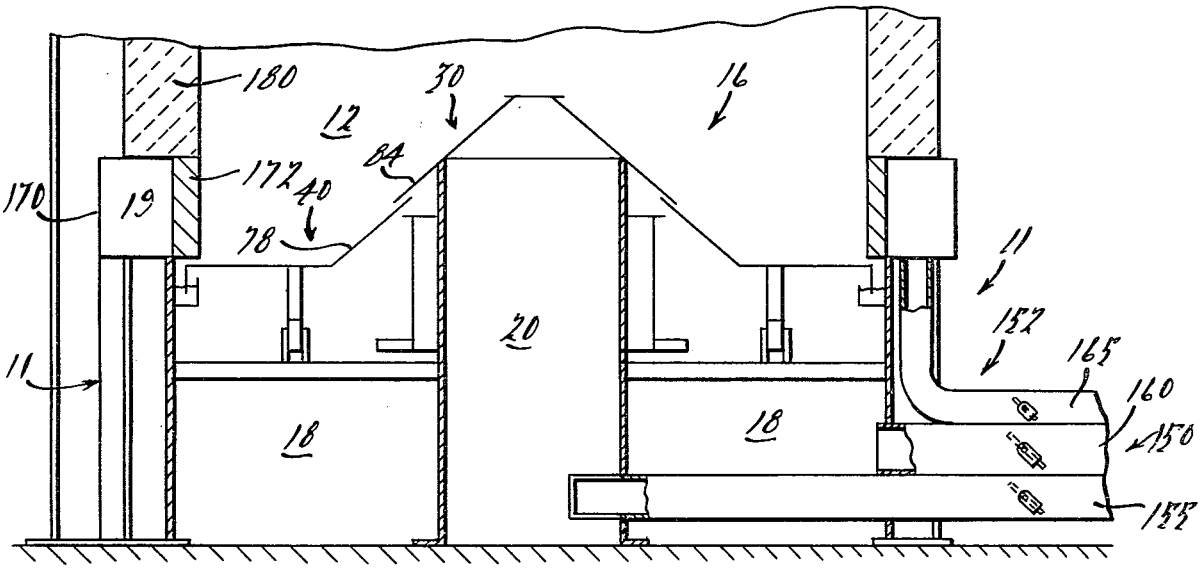
FIG. 4 is a diagrammatic vertical sectional view along the line 4—4 of FIG. 2.
Figure 5:
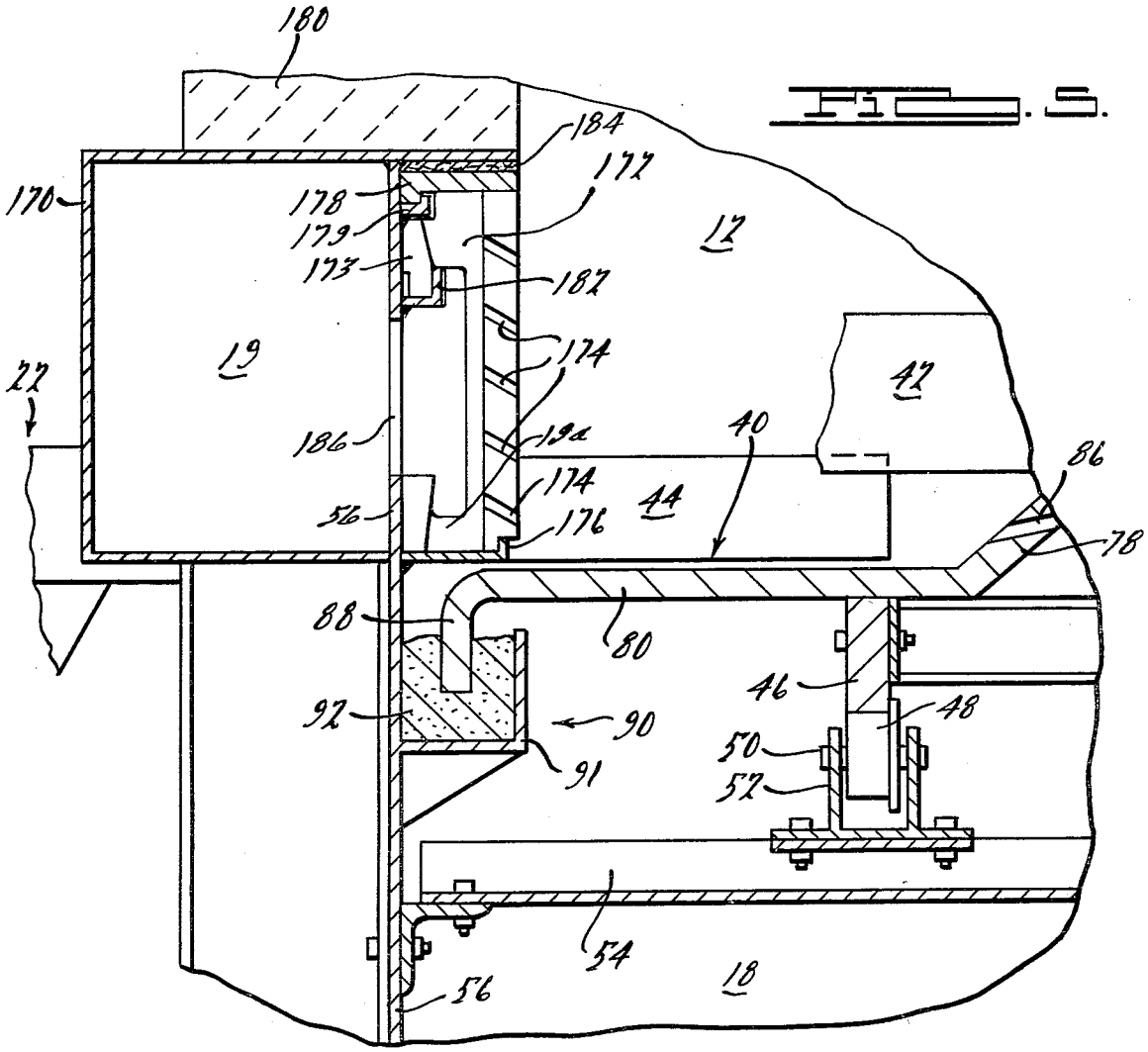

As seen in FIG. 4, the lower duct 155 is operably associated with air plenum 20 to provide high pressure air to the underside of the central stationary section 30 of the grate 16. The high pressure air is passed to the fuel through the tuyeres 62, as shown in FIG. 3.

The middle duct 160 is operably associated with air plenum 18 to provide the relatively lower pressure air to the underside of the overhang section 84 of the central stationary section 30 and the inclined section 78 of the outer rotating ring 40.

The upper duct 165 is operably associated with the optional furnace wall air plenum 19 to provide high pressure air to an annular duct 170 at the periphery of the refractory portion 180 of the housing 11 positioned axially above the surface of the circular grate 16. The radially inner portion of said annular duct 170 is comprised of a series of grates 172 having rows of tuyeres 174 spaced circumferentially along the extent of the periphery of the furnace area 12, as shown in FIGS. 2 and 3.

Figure 6:
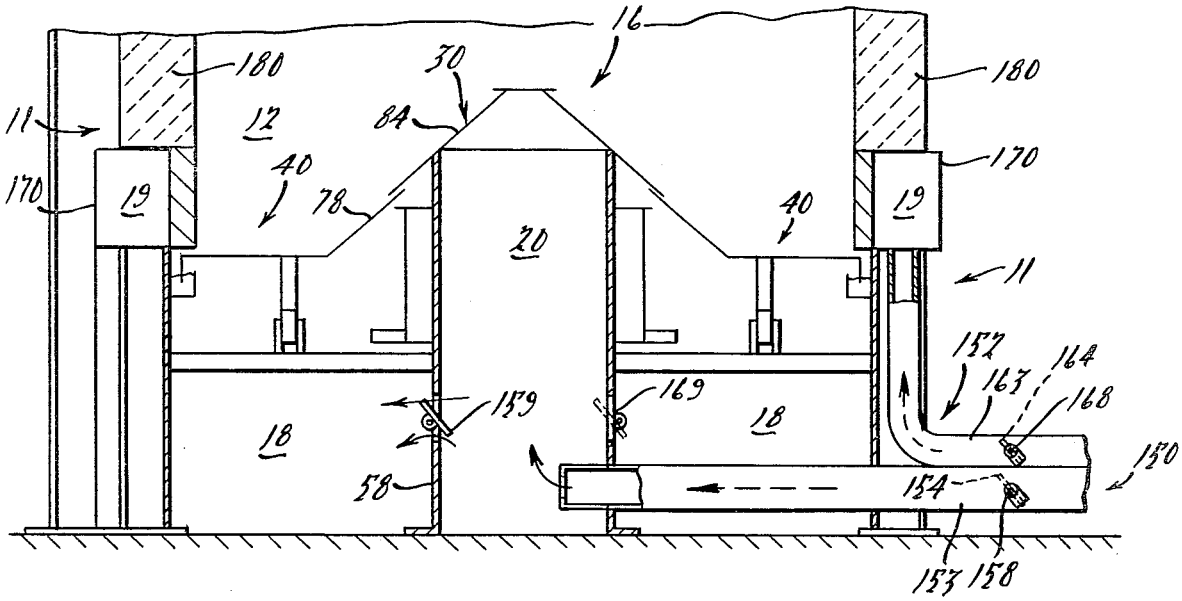
FIG. 6 is a diagrammatic view similar to FIG. 4 showing alternative means for control of air flow.

An alternative air supply system is shown in FIG. 6. In this alternative embodiment, the air supply duct 152 is divided into only two ducts 153 and 163, having control dampers 154 and 164, and adjustment knobs 158 and 168.

The lower duct 153 is operably associated with air plenum 20 to provide high pressure air to the underside of the central stationary section 30 of the grate 16, as detailed above.

The upper duct 163 is operably associated with the optional furnace wall air plenum 19 to provide high pressure air to the annular duct 170 at the periphery of the refractory 180 as detailed above.

The furnace wall air plenum 19 is optional based upon the type of unit with which the rotary continuous ash discharge stoker of the present invention is used. When the grate is part of a gasifier unit or the like, where it is not desirable to dilute the gas resulting from the combustion process with air, the furnace wall air plenum 19 and the air supply duct attached thereto (165 in FIG. 4 or 163 in FIG. 6) would not be included in the construction of the present invention.

Air flow to air plenum 18 is controlled by butterfly valves 159 and 169, operably attached to the inner plenum wall 58. The rotation of the valves 159 and 169 is controlled by a rotatable rod (not shown) which extends through a seal in the housing 11 to a control knob outside the housing 11, as is known in the art. The valves 159 and 169 provide the relatively lower pressure air to the underside of the overhang section 84 of the central stationary section 30 and the inclined section 78 of the outer rotating ring 40.

If the furnace wall air plenum is used, each furnace wall grate 172 is supported within the duct 19 along the furnace wall as shown in FIG. 2. Each grate 172 has a C-shaped configuration when viewed from the side. Referring to FIG. 5, the base of the grate 172 is retained by an annular support flange 176 welded to the outer wall 56. The grate 172 also has an extended portion 173 which fits securely into a second annular support flange 182 welded to the outer wall 56. A grate cap 178 is seated at the top of the grate 172 and is also supported by annular flange 179. After the grate cap 178 and grate 172 are installed, a heat resistant, compressible material 184, such as ceramic fiber or rock wool, is packed above the grate cap 178.

The tuyeres 174 are downwardly directed to prevent fuel and ash from sifting into the furnace wall air plenum 19. The outer wall 56 has passages 186 so that the air plenum 19 can direct air into the inner air plenum **19*a* communicating directly with the tuyeres 174 to admit high pressure air into the furnace area 12 above the surface of the circular grate 16. The admission of additional air along the sidewall in this manner permits a further control and coordination of fuel and air with respect to load demand to obtain complete combustion of the fuel both on the grate 16 and in suspension above the grate 16** at any particular combination of load demand, air and fuel. This is particularly important to maintain combustion at low loads and is essential for an approach to complete combustion at high loads, although, as stated previously, in some instances, such as when the grate is part of a gasifier unit, air-cooled tuyeres on the furnace wall would not be used.

The sidewall air also provides a great deal of turbulence which, in combination with the furnace wall seal 90, will reduce stratification of air along the furnace walls where it could not be efficiently utilized in the combustion process. Furthermore, the flow of air will cool the sidewall to eliminate clinker formation or slag adhesion to the refractory or the furnace wall in this area of the furnace 12.

The rotary continuous ash discharge stoker 10 as described herein has numerous advantages as recited above. An overfeed stoker with a substantial variety of controls and admission areas for the forced draft air of varying pressures will provide for more efficient combustion of fuel at various load requirements and fuel/air combinations. The present invention further allows flexibility to have additional air admitting zones either concentrically with the present zones or sliced at intervals circumferentially at different stages of combustion as the fuel traverses an expanding spiral path around the grate 16. Various feeder arrangements either from above or below are totally compatible with the present invention.

Figure 7:
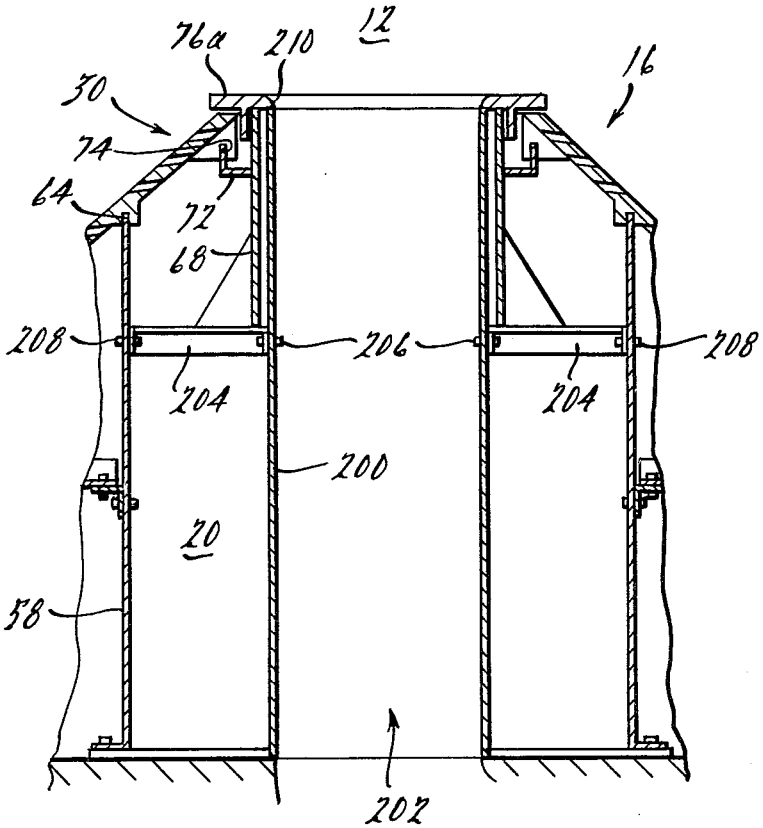
FIG. 7 is a fragmentary sectional view similar to FIG. 3 illustrating alternative fuel feed means.

An underfeed embodiment is illustrated in FIG. 7. A feed tube 200 extends axially through the inner air plenum 20 and the central stationary section 30 of the grate 16, concentric with the inner plenum wall 58. The central cap **76*a* is an annulus, separating of the inner air plenum 20 from the furnace area 12 and the feed area 202. The central stationary section 30 is still jointly supported at support grooves 64 and 74 by the inner plenum wall 58 and annular support flange 72 respecitively. Annular support flange 72 is fixedly attached to cylinder 68, which in turn is supported by and attached to joists 204. Joists 204 extend from the inner plenum wall 58 to the feed tube 200 and are fixedly attached thereto by conventional fasteners 206 and 208. Furhter details of construction can be gleaned from FIGS. 2 and 3** as described above.

A drive screw, a ram, or other feed means as known in the art may be utilized within the feed tube 200 to feed fuel to the grate directly at the outlet point 210 of the feed tube 200 or at a higher discharge point released above the grate.

Thus, there is disclosed in the above description and in the drawings an illustrative embodiment of the invention which fully and effectively accomplishes the objects thereof. However, it will be apparent that variations in the details of the apparatus may be indulged in without departing from the sphere of the invention herein described, or the scope of the appended claims.

What is claimed is:

1. In a rotary stoker or the like having an inner wall forming a furnace combustion chamber, a grate on which burning fuel is supported and means to admit air from below the grate to said fuel, an improved air supply system comprising:

a central stationary section and an outer rotating ring forming said grate and defining a continuous fuel supporting surface across said central stationary section and outer rotating ring;

at least two separate air planums located under said grate to supply pressurized air to the fuel continuously throughout the extent of travel of said fuel along the continuous fuel supporting surface, said grate forming the upper wall of each said separate air plenum;

air supply means to supply pressurized air to said plenums;

means to separately control the air pressure supplied to each air plenum; and means for sealing the outer periphery of said grate along said inner wall.

2. A stoker in accordance with claim 1, wherein an air compartment connected to a pressurized air supply means is included along the sidewall of said housing located above the radially outer portion of said grate having means to admit air into the furnace chamber.

3. A stoker in accordance with claim 1, wherein said air plenums are concentric within said housing.

4. A stoker in accordance with claim 1, further comprising feed means directing fuel to said grate and ash discharge means operably associated with said outer rotating ring whereby said grate provides movement of the fuel as it burns, from a feedpoint to an ash discharge point.

5. A stoker in accordance with claim 4, wherein said fuel moves in a generally spiral path relative to said central stationary section from said feedpoint to said ash discharge point.

6. In a rotary stoker or the like having a grate on which burning fuel is supported, means to admit air from below the grate to said fuel, and an inner wall forming a furnace combustion chamber, an improved air supply system comprising:

a central stationary section and an outer rotating ring forming said grate and defining a continuous fuel supporting surface across said central section and outer ring;

means for admitting air to said fuel from below said grate at locations throughout said continuous fuel supporting surface;

at least one compartment located directly under said grate to supply pressurized air to the fuel through said grate;

a compartment located above said grate along said inner wall to supply pressurized air to said chamber above said grate;

air supply means to supply pressurized air to said compartments;

means to separately control the air pressure supplied to each compartment.

7. A stoker in accordance with claim 6, wherein said air supply means includes at least two compartments formed below said grate wherein at least one of said compartments communicates with said central stationary section and at least one other compartment communicates with said outer ring, and said air supply means further includes means to separately control the air pressure in each of said compartments.

8. A stoker in accordance with claim 6, wherein said outer rotating ring has a downwardly extending flange at its radially outward periphery and said stoker further comprises sealing means, comprising an annular through extending along and secured to the inner wall of said housing, and filler means disposed in said trough and operably associated with said outer ring flange to provide a seal.

9. A rotary stoker comprising:

a housing having an inner wall forming a furnace combustion chamber;

support means located within said housing to support burning fuel, comprising a circular grate having a continuous fuel supporting surface for burning fuel comprising a central stationary section and an outer rotating ring, said central stationary section being of a generally hollow frusto-conical configuration having a plurality of tuyeres disposed in said section, said tuyeres being directed generally radially outwardly, and said outer rotating ring concentric with said central section and located radially outwardly of said central section;

means to supply pressurized air into said housing below said circular grate throughout the extent of said continuous fuel supporting surface;

a plurality of air plenums formed below said circular grate, connected to said air supply means, to supply pressurized air to said tuyeres, said grate forming one wall of each said air plenum; and drive means to drive said outer ring of said circular grate.

10. A stoker in accordance with claim 9, wherein at least one of said plenums communicates with said central stationary section and at least one other plenum communicates with said outer ring, and said outer ring has means to admit air from said plenum to the grate surface.

11. A stoker in accordance with claim 10, further comprising means to separately control the pressure of the air in the central stationary section plenum and the air in the said outer ring plenum.

12. A stoker in accordance with claim 11, wherein the air pressure in the outer ring plenum is lower than the air pressure in the central section plenum.

13. A stoker in accordance with claim 10, wherein a plurality of air plenums are located under said central stationary section.

14. A stoker in accordance with claim 9, wherein a plurality of air plenums are formed under said central stationary section.

15. A stoker in accordance with claim 9, furher comprising an air compartment along said inner wall of the housing, located above the outer portion of said grate, having means to admit air into said furnace chamber, and connected to said pressurized air supply.

16. A stoker in accordance with claim 15, wherein said air admission means comprises grates having a multiplicity of tuyeres operably connected to said inner wall air compartment.

17. A stoker in accordance with claim 9, wherein said tuyeres are directed downwardly to prevent fuel and ash from sifting into the corresponding air compartment.

18. A stoker in accordance with claim 9, wherein said outer rotating ring has sealing means at the inner wall of the housing to reduce air leakage along said wall.

19. A stoker in accordance with claims 18, wherein said outer rotating ring has a downwardly extending flange at its outer periphery and said sealing means comprises an annular trough extending along and secured to the inner wall of said housing, and filler means disposed in said trough and operably associated with said outer ring flange to provide a seal.

20. A stoker in accordance with claim 9, wherein said circular grate is supported by roller means and said roller means comprises:

a rail attached to the underside of said outer rotating ring; and rollers spaced circumferentially along the underside of said outer rotating ring to rotatably support said outer retaining ring.

21. A stoker in accordance with claim 9, wherein said stoker further comprises ash discharge means operably associated with said outer rotating ring at a single ash discharge point.

22. A stoker in accordance with claim 21, wherein said ash discharge means includes an adjustable stationary ash plow located transversely across the upper surface of said outer rotating ring, a chute located outside said housing, and passage means through which ash is directed by said plow into said chute.

23. A stoker in accordance with claim 9, further comprising a spreader attached to said inner wall of said housing to distribute the fuel evenly over said grate.

24. A rotary stoker comprising:

a housing having an inner wall forming a furnace combustion chamber:

support means located within said housing to support burning fuel, comprising a circular grate having a central stationary section and an outer rotating ring, said central stationary section being of a generally hollow frusto-conical configuration having a plurality of tuyeres disposed in said section with at least one set of tuyeres disposed near the base portion of said section, said tuyeres being directed generally radially outwardly, and said outer rotating ring being concentric with said central section and located radially outwardly of said central section;

means to supply pressurized air into said housing below said circular grate;

a plurality of air plenums formed below said circular grate, connected to said air supply means, to supply pressurized air to said tuyeres, including a plurality of air plenums formed under said central stationary section, said grate forming one wall of each said air plenum, wherein at least one plenum communicates with the base portion of the central stationary section in which the tuyeres are located and at least one other plenum communicates with the other portion of the central stationary section; and drive means to drive said outer ring of said circular grate.

25. A stoker in accordance with claim 24, wherein the base portion of said central stationary section overlaps the radially inner portion of said outer rotating ring.

26. In a rotary stoker, including a furnace housing and a rotating grate, which stoker produces particulate filter means as residue during its operation, an improved seal between the inner wall of said furnace housing and said grate comprising:

a downwardly extending flange disposed at one of the outer periphery of said rotating grate or said inner wall of said furnace housing;

an annular trough disposed along the other of the outer periphery of said grate or said inner wall, at least a portion of which is disposed below the outer periphery of said rotating grate and communicates with the upper surface of said grate; and means for directing said particulate filler means into said trough during the operation of said stoker, the lower edge of said downwardly extending flange being disposed below the top level of said filler means along the entire periphery of said rotating grate, whereby a seal is maintained between the outer periphery of said grate and the inner periphery of said housing wall.

27. A rotary stoker comprising:

a housing having an inner wall forming a furnace combustion chamber;

support means located within said housing to provide a continuous surface to support burning fuel and passage means for passing air from below said support means to said fuel at positions throughout the extent of said continuous surface of said grate, comprising:

a circular grate having a central stationary section and an oute rotating ring to provide said continuous fuel supporting surface, said outer rotating ring being concentric with said central section and disposed radially outwardly of said central section;

means to supply pressurized air into said housing below said circular grate;

a plurality of air plenums formed below said circular grate, connected to said air supply means, to supply pressurized air to said fuel through said passage means, said grate forming one wall of each said air plenum;

drive means to drive said outer ring of said circular grate; and means for sealing said grate at said inner wall;

wherein fuel is fed to the center of said support means, ash residue exits at the radially outer edge of said support means and said combustion chamber is sealed from said air plenums except for pressurized air passing from said air plenums to said combustion chamber through said passage means of said support means.

28. A stoker in accordance with claim 27, wherein an air compartment is included along the inner wall of said housing located above said grate having means to admit air into the furnace chamber and connected to said pressurized air supply means.

29. A furnace comprising:

(a) an inner wall forming a furnace combustion chamber;

(b) a grate disposed in said combustion chamber for supporting burning fuel, said grate comprising a central stationary section and an outer rotating ring, said grate having a fuel supporting surface across said central section and outer ring;

(c) a first compartment located directly under said grate for supplying pressurized air through said grate to the fuel supported thereon;

(d) a second compartment located above said grate along said inner wall for supplying pressurized air to said combustion chamber above said grate;

(e) air supply means for supplying pressurized air to both of said compartments;

(f) means for separately controlling the air supplied to each of said compartments;

(g) first annular means disposed on said inner wall and second annular means disposed about the periphery of said rotating ring, wherein one of said first and second annular means overhangs the other of said first and second annular means to form a seal.

30. A stoker in accordance with claim 29, further comprising supply means for supplying fuel to said central stationary section, said supply means being disposed below said central stationary section.

31. The furnace according to claim 29 wherein said second annular means includes flange disposed within said first annular means.

32. The furnace according to claim 29 wherein said first compartment is located under said central stationary section.

33. The furnace according to claim 29 wherein said first compartment is located under said outer rotating ring.

34. The furnace according to claim 29 further comprising ratchet drive means for rotating said outer rotating ring.

* * * * *

UNITED STATES PATENT AND TRADEMARK OFFICE

CERTIFICATE OF CORRECTION

PATENT NO. : 4,437,452

DATED : March 20, 1984

INVENTOR(S) : David C. Reschly

It is certified that error appears in the above-identified patent and that said Letters Patent are hereby corrected as shown below:

Column 6, lines 61 and 62, "respecitively" should be -- respectively --.

Column 6, line 66, "Furhter" should be -- Further --.

Column 8, line 20, "through" should be -- trough --.

Column 9, line 1, "furher" should be -- further --.

Column 10, line 14, "filter" should be -- filler --.

Column 10, line 44, "oute" should be -- outer --.

Signed and Sealed this

*Fourteenth* Day of *August 1984*

[SEAL]

*Attest:*

GERALD J. MOSSINGHOFF

*Attesting Officer*

*Commissioner of Patents and Trademarks*